United States Patent [19]

Messner et al.

[11] Patent Number: 4,782,873

[45] Date of Patent: Nov. 8, 1988

[54] FITTED TOOL BOX COVER

[76] Inventors: Kenneth Messner, 825 Cascade Dr., San Jose, Calif. 95129; William Camara, 1082 Princess Ann Dr., San Jose, Calif. 95128

[21] Appl. No.: 53,847

[22] Filed: May 26, 1987

[51] Int. Cl.[4] ..... B65D 65/02; B65D 65/24

[52] U.S. Cl. ..... 150/52 R; 190/18 A; 312/DIG. 33

[58] Field of Search ..... 150/52 R, 52 E, 52 F; 312/DIG. 33; 190/26, 18 A

[56] References Cited

U.S. PATENT DOCUMENTS

| | | | |
|---|---|---|---|
| D. 240,882 | 8/1976 | Knight | D6/269 |
| 276,270 | 4/1883 | Oliver | 150/52 R |
| 485,309 | 11/1892 | Weightman | 150/52 R |
| 1,502,096 | 7/1924 | Gilmore | 150/52 R |
| 2,467,471 | 4/1949 | Goldstein | 150/52 R |
| 2,546,478 | 3/1951 | Sims | 150/52 R |
| 2,647,595 | 8/1953 | Meyers | 150/52 R X |
| 2,656,869 | 10/1953 | Timmons | 150/52 R X |
| 2,705,519 | 4/1955 | Kaiser | 150/52 R |
| 2,917,094 | 12/1959 | Sullivan | 150/52 R |
| 3,185,197 | 5/1965 | Spiro et al. | 150/52 R |
| 3,242,960 | 3/1966 | Schwartzman | 150/52 R |
| 3,500,044 | 3/1970 | Treadway | 150/52 R |
| 3,665,991 | 5/1972 | Gillemot et al. | 150/52 R |
| 4,000,678 | 1/1977 | Messina | 150/52 R X |
| 4,177,847 | 12/1979 | Spindler | 150/52 R |
| 4,601,391 | 7/1986 | Gibbs et al. | 150/52 R X |
| 4,682,691 | 7/1987 | Spiering | 150/52 R X |

*Primary Examiner*—William Price
*Assistant Examiner*—Sue A. Weaver
*Attorney, Agent, or Firm*—Douglas A. Chaikin

[57] ABSTRACT

A fitted cover for tool boxes including a first member having a top, back and side portions. The top and side portions define an open face. The top and side portions include a border adjacent the open face and extending therein. The first member including a tensioning member extending from one side portion to the other side portion. A second member defining a first portion being sized and shaped to fit compatibly over the first member open face. The first and second members including a plurality of fastening means along the periphery of the second member and the border of the first member.

11 Claims, 1 Drawing Sheet

FITTED TOOL BOX COVER

FIELD OF INVENTION

This invention relates to fitted covers for tool boxes and more particularly to fitted covers which are adjustable and removable.

BACKGROUND OF THE INVENTION

The value of covers for protecting valuable equipment is well recognized. Covers have been used to protect, among other things; commodes, such as U.S. Pat. No. 2,705,519; shopping carts, such as U.S. Pat. No. 2,917094; guitars, such as U.S. Pat. No. 4,177,847; test equipment, such as U.S. Pat. No. 3,665,991; chest, shelves, boxes and similar household storage and display devices, such as U.S. Pat. No. 3,242,960; portable radios, such as U.S. Pat. No. 2,467,471; sewing machines, such as U.S. Pat. No. 276,270; and clothes washers and dryers, such as U.S. Pat. No. 3,500,044.

Each of the above covers have used various means to cover their particularly intended piece of equipment. For example, velcro-type fasteners have been used with the cover described in Spiro et al, U.S. Pat. No. 3,185,197. Spiro et al discloses a modular protective cover for covering various sized elements in different integral pieces. Other covers have included cover flaps such as U.S. Pat. No. 2,917,094. Still others have shown tightening means such as U.S. Pat. No. 2,647,595.

However none of these covers have been specifically designed for use with a tool box. A tool box typically stores tools for working on motor vehicles and the like. The typical environment for working on such motor vehicles is quite corrosive and easily lends the tool box to being scratched by tools or other things commonly found in such an environment. None of the above mentioned covers are designed to be used as a fitted cover for a tool box in such an environment. The cover must protect the tool box from corrosive materials as well as from being scratched. Additionally a tool box cover requires a special design because the drawers of the tool box must be readily accessible while the cover is protecting the tool box.

Tool boxes are quite expensive and range in price from $1,500 to over $10,000. It would be useful if a cover could be used which protects the tool box from the corrosive environment while allowing access to the tools. The tool box cover should also add to the appearance of the tool box. However, despite the acknowledged need and the commercial success of such above described tool boxes and of covers in general, no cover has yet been available which satisfies the above needs. This is no despite the fact that covers have become a crowded art.

SUMMARY OF THE INVENTION

It is the general object of this invention to provide a fitted cover which protects a tool box while allowing ready access to the tools.

It is a further object of this invention to provide a tool box cover which substantially encloses a tool box while being easily removable.

It is a further object of this invention of this invention to provide a fitted tool box cover which fits compatibly with an auxiliary document and tool holder.

It is the further object of this invention to provide a tool box cover which can be used repeatedly with a minimum of wear and maintenance.

In accordance with the above described objects, the fitted tool box cover of this invention comprises:

a first member having a top, back and side portions, the top and side portions defining an open face, the top and side portions include a border adjacent the open face and extending therein, and the first member including a tensioning member extending from one side portion the other;

a second member defining a front cover being sized and shaped to fit compatibly over the first member open face; and a plurality of fastening means along the periphery of the second member and the border of the first member for removably attaching the second member to the first member.

A preferred embodiment of the invention includes the tensioning member being adjustable and the side portions having openings for allowing the tool box handle to be inserted therethrough.

It is an advantage of this invention to provide a fitted tool box cover which allows easy access to the tools while providing maximum protection for the tool box.

It is the further advantage of this invention that the fitted tool box cover of this invention may be fully enclosed.

It is still a further advantage that the tool box cover of this invention is easily fitted over the tool box and can be done so repeatedly with a minimum of ware and maintenance.

These and other objects and advantages of the invention will be more fully appreciated with reference to the detailed description of the invention and the drawing.

DETAILED DESCRIPTION OF THE INVENTION

Figure 1:
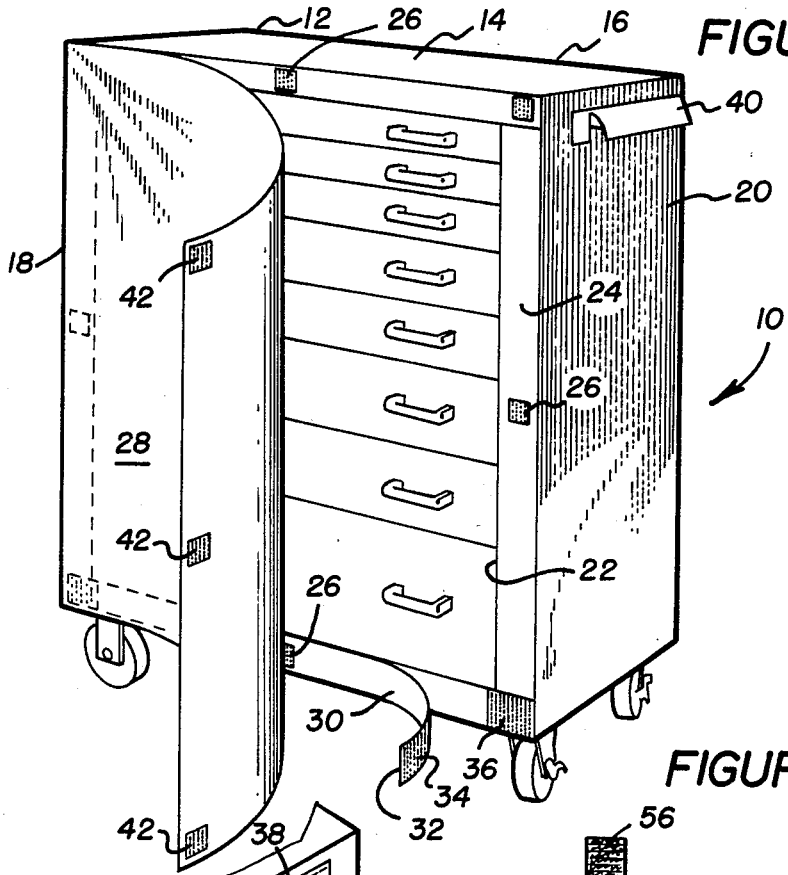
FIG. 1 is an elevated perspective view illustrating the fitted cover of this invention fitted over a tool box.
Figure 2:
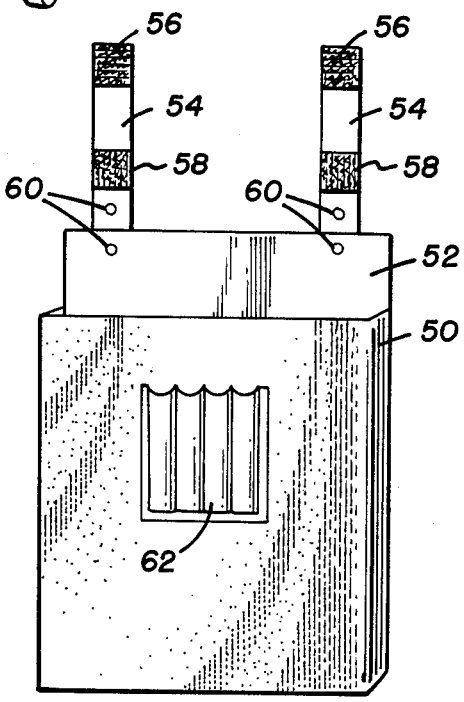
FIG. 2 is an elevated perspective view illustrating the auxiliary document and tool holder of this invention.
Figure 3:
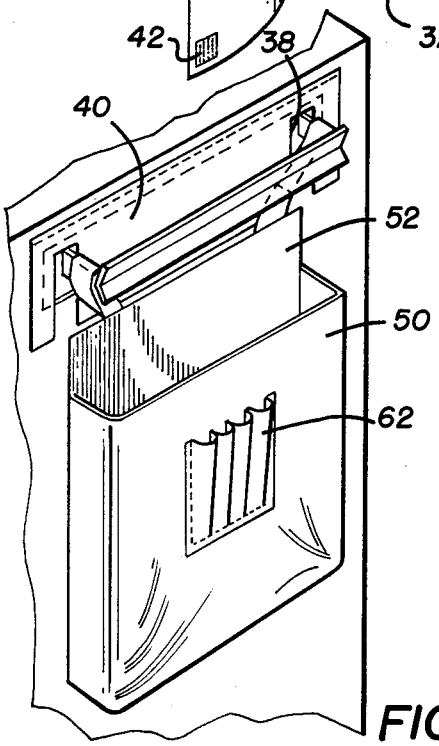
FIG. 3 is a partially cut away perspective view showing the auxiliary document and tool holder of this invention attached to and compatibly nested with the fitted cover.

With reference to the drawing, there is shown the preferred embodiment of the invention. FIG. 1 shows the invention in use and FIGS. 2 and 3 illustrate the auxiliary document and tool holder by itself and in nesting relationship with the fitted cover of this invention.

With particular reference to FIG. 1, there as shown the invention generally indicated by the numeral 10, comprising a fitted tool box cover. The fitted tool box cover 10 includes a first member 12 having a top 14, a back 16 and side portions 18 and 20. The top 14 and side portions 18 and 20 define an open portion comprising an open face 22. Along the periphery of the open face 22 the side portions 18 and 20 and the top 14 have a border 24.

The border 24 includes a plurality of fastening means 26. The fastening means are made of a female fastening member being of fibrous material and a male fastening member comprising a plurality of small hooks. The fastening means are well known as VELCRO fasteners.

The fastening means 26 fastens a second member 28 to first member 12 as will be explained more fully hereinafter. It is preferable that the border include a female VELCRO member as it is easier for the member being attached and detached, namely, the second member 28, to contain the male member of the VELCRO.

A tensioning member 30 extends from side portion 18 to side portion 20. The tensioning member 30 has a proximal end (not shown) affixed to the side portion 18. The preferred material for the tool box cover is a heavy weight nylon. However, canvas and like material can also be used successfully. The preferred means of affixing the tensioning member 30 to side portion 18 is by sewing and reinforcing same. The tensioning member 30 has a distal end 32 having a male VELCRO fastening member 34, which covers the entire distal end. The bottom of side border 24 includes a female VELCRO member 36 which is sized and shaped to compatibly fit with male VELCRO member 34. The tension exerted by tensioning member 30 may be increased or decreased by adjusting the position of the distal end 32 relative to the female VELCRO member 36. Additionally, the tensioning member 30 may be attached and detached many times with only minimal maintenance and wear The fitted cover 10 includes side portions 18 and 20 each having openings 38 and side flaps 40. The openings 38 are sized and shaped so that the handle of the tool box can be inserted through the openings 38 as shown in FIG. 3. The side flap 40 is sewn into the nylon of the cover first member 12 and affixed thereto. The side flap 40 may cover the tool box handle as shown FIG. 1 or may be inserted under the tool box handle as shown in FIG. 3.

The second member 28 defines a front cover which fits over the open face 22 of the first member 12, including the border 24. The front cover 28 covers the front of the tool box where the drawers holding the tools are located. At the end of the work day, when the tools have been put away and it is desirable to have a neat looking appearance, the front cover 28 is especially advantageous. Additionally, the front cover 28 keeps dust and other particulate matter away from the tool box.

A plurality of fastening members 42 are fixed to the periphery of the second member 28. The fastening members 42 comprise male VELCRO members and are spaced along the periphery of second member 28 to compatibly mate with female VELCRO members 26. Additionally, tensioning member 30 includes fastening members 26 at its proximal and distal ends as well as at its mid-portion. This additionally helps secure the second member 28 to the first member 12 and prevents dust and particulate matter from getting into the tool box. It will be appreciated that the second member 28 may be adjusted to the first member 12 and tightened and loosened as desired.

IN USE

The first member 12 is slipped over the tool box. The tensioning member 30 is then tensioned as desired. After work with tools has been completed, the drawers are closed and the second member 28 is attached to the first member 12 by fastening members 26 and 42. When it is desirable to use the tools, the second member 28 is removed and the drawers are easily accessible. The side flaps 40 may be tucked inside the handles of the tool box or over the top as desired.

With particular reference to FIG. 2, there is shown an auxiliary document and tool holder generally indicated by the numeral 50. The auxiliary document and tool holder 50 includes a pouch portion 52 having a space for holding documents and tools. The holder 50 is the size of a standard sized envelope for holding work orders and other documents. Extending from the pouch portion 52 are a pair of straps 54. The straps include male and female VELCRO ends 56 and 58, respectively, and pairs of holes 60.

The auxiliary document and tool holder 50 may be connected to the tool box by attaching the straps 54 to the extension portion of the handle as shown in FIG. 3. With a half twist, the straps 54 are fed from the inside over the extension portion of the tool box handle and the male VELCRO member 56 is attached to the female VELCRO member 58. The axuiliary document and tool holder 50 then compatibly nests with the cover 10.

Although not shown, the tool box commonly only includes one handle, either on the left or right side of the tool box. This pouch may be attached on either side. As shown in FIG. 3, the auxiliary document and tool holder 50 may be hung over the extensions of the tool box handle with the side flaps 40 either covering the handle or inserted inside the handle, with no affect on the attachment of the auxiliary document and tool holder 50 to the tool box. Additionally, although not shown, when the handle of the tool box is removed small screw holes, the size and shape of holes 60 are left in the tool box. When it is desirable to attach the auxiliary document and tool holder 50 to the side of the tool box where the hanle is not, the straps 54 are bent down until holes 60 align on each strap and a screw is inserted through holes 60 and fastened into the tool box.

The auxiliary document and tool holder 50 includes an outer pocket 62 for holding pens and pencils. This is especially useful because if pens or pencils and a like are left in the tool box or in the auxiliary document and tool holder they are easily crushed and ruined by the tools which can be quite heavy compared to a writing implement. The outer pocket 62 provides an efficient means for holding such pens and pencils.

Applicants have thus invented a fitted tool box cover and a compatibly nesting auxiliary document and tool holder both of which are detachable from a tool box and both of which are adjustable with respect to the tool box and with respect to each other.

While the forgoing has described certain preferred embodiments of the invention in detail and with particularly, the foregoing is merely illustrative of the invention, it is not meant to limit the invention. The invention is limited only by the appended claims.

We claim:

1. A fitted tool box cover, comprising:

a first member having a top, back and side portions, the top and side portions defining an open face, the top and side portions include a border adjacent the open face and extending therein, and the first member including a tensioning member extending from one side portion to the other;

a second member defining a front cover being sized and shaped to fit compatibly over the first member open face; and a plurality of fastening means along the periphery of the second member and the border of the first member for removably attaching the second member to the first member.

2. A fitted tool box cover as set forth in claim 1, wherein the tensioning member has a proximal end affixed at the bottom portion of the one side portion and detachable from the other side portion.

3. A fitted tool box cover as set forth in claim 2, wherein the tensioning member includes means for adjusting the tension.

4. A fitted tool box cover as set forth in claim 2, wherein the tensioning member includes compatible means for fastening the second member to the first member.

5. A fitted tool box cover as set forth in claim 2, wherein the tensioning member may be attached and detached many times with minimal maintenance.

6. A fitted tool box cover as set forth in claim 2, wherein the distal end of the tensioning member and the other side portion include compatible fastening means.

7. A fitted tool box cover as set forth in claim 6, wherein the fastening means are made from male and female VELCRO portions.

8. A fitted tool box cover as set forth in claim 1, wherein the side portions include openings for tool box handles and side flaps.

9. A fitted tool box cover as set forth in claim 1, wherein the cover is made of a heavy weight nylon material.

10. A fitted tool box cover as set forth in claim 1, wherein the cover is made of a canvas-type material.

11. A fitted tool box cover as set forth in claim 8, wherein the cover includes an auxiliary document and tool holder removably attached to the handle of the tool box and nesting compatibly with the side flaps.

* * * * *